US007602266B2

(12) United States Patent
Menard et al.

(10) Patent No.: US 7,602,266 B2
(45) Date of Patent: Oct. 13, 2009

(54) MEMS ACTUATORS AND SWITCHES

(75) Inventors: Stephane Menard, Kirkland (CA); Jun Lu, Lasalle (CA); Nicolas Gonon, Dorval (CA)

(73) Assignee: Réseaux MEMS, Société en commandite, Montréal (CA)

( * ) Notice: Subject to any disclaimer, the term of this patent is extended or adjusted under 35 U.S.C. 154(b) by 60 days.

(21) Appl. No.: 11/687,572

(22) Filed: Mar. 16, 2007

(65) Prior Publication Data

US 2008/0223699 A1 Sep. 18, 2008

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 5,796,152 | A * | 8/1998 | Carr et al. | 257/415 |
| 5,962,949 | A * | 10/1999 | Dhuler et al. | 310/307 |
| 6,236,300 | B1 * | 5/2001 | Minners | 337/139 |
| 7,312,678 | B2 * | 12/2007 | Ning et al. | 335/78 |
| 2004/0261412 | A1 * | 12/2004 | Hickey | 60/527 |
| 2007/0170811 | A1 * | 7/2007 | Rubel | 310/307 |

* cited by examiner

*Primary Examiner*—Elvin G Enad
*Assistant Examiner*—Bernard Rojas
(74) *Attorney, Agent, or Firm*—Alexandre Abecassis; Fasken Martineau DuMoulin LLP

(57) ABSTRACT

Microelectromechanical (MEMS) structures and switches employing movable actuators wherein particular ones of which move perpendicular to an underlying substrate and particular others move in a direction substantially parallel to the underlying substrate thereby providing more positive actuation.

5 Claims, 11 Drawing Sheets

6(b)

MEMS ACTUATORS AND SWITCHES

FIELD OF THE INVENTION

This application relates generally to the field of microelectromechanical systems (MEMS) and in particular to improved MEMS actuator configurations and switches constructed therefrom.

BACKGROUND OF THE INVENTION

Microelectromechanical systems (MEMS) are small, movable, mechanical structures built using well-characterized, semi-conductor processes. Advantageously, MEMS can be provided as actuators, which have proven to be very useful in many applications.

Present-day MEMS actuators quite small, having a length of only a few hundred microns, and a width of only a few tens of microns. Such MEMS actuators are typically configured and disposed in a cantilever fashion. In other words, they have an end attached to a substrate and an opposite free end which is movable between at least two positions, one being a neutral position and the others being deflected positions.

Electrostatic, magnetic, piezo and thermal actuation mechanisms are among the most common actuation mechanisms employed MEMS. Of particular importance is the thermal actuation mechanism.

As is understood by those skilled in the art, the deflection of a thermal MEMS actuator results from a potential being applied between a pair of terminals, called "anchor pads", which potential causes a current flow elevating the temperature of the structure. This elevated temperature ultimately causes a part thereof to contract or elongate, depending on the material being used.

One possible use for MEMS actuators is to configure them as switches. These switches are made of at least one actuator. In the case of multiple actuators, they are typically operated in sequence so as to connect or release one of their parts to a similar part on the other. These actuators form a switch which can be selectively opened or closed using a control voltage applied between corresponding anchor pads on each actuator.

MEMS switches have many advantages. Among other things, they are very small and relatively inexpensive—depending on the configuration. Because they are extremely small, a very large number of MEMS switches can be provided on a single wafer.

Of further advantage, MEMS switches consume minimal electrical power and their response time(s) are extremely short. Impressively, a complete cycle of closing or opening a MEMS switch can be as short as a few milliseconds.

Although prior-art MEMS actuators and switches have proven to be satisfactory to some degree, there nevertheless remains a general need to further improve their performance, reliability and manufacturability.

SUMMARY OF THE INVENTION

We have developed improved MEMS structures employing movable conductive member and a number of current-carrying stationary contact terminals which advantageously permits higher current carrying capability that prior art devices in which currents flowed through movable conductive members. Advantageously, and in sharp contrast to the prior art, our inventive structures may carry currents in excess of 1.0 amp without the need for additional current limiting devices. Consequently, systems employing our inventive structures exhibit significantly lower overall system manufacturing costs.

Viewed from a first aspect, the present invention is directed to MEMS actuators and switches useful for a variety of applications including high current ones.

Viewed from another aspect, the present invention is directed to MEMS actuators and switches constructed therefrom wherein the actuators move in directions not disclosed in the prior art, i.e., perpendicular to a planar substrate upon which they are anchored.

Viewed from yet another aspect, the present invention is directed to MEMS actuators and switches exhibiting a hybrid combination of directional movements, i.e., structures including elements that move in directions parallel to a substrate surface and elements which move perpendicular to those substrate surfaces.

BRIEF DESCRIPTION OF THE DRAWING

A more complete understanding of the present invention may be realized by reference to the accompanying drawing in which:

FIG. 4 shows a schematic of an alternate embodiment of the exemplary MEMS switch of FIG 1;

DETAILED DESCRIPTION

The following merely illustrates the principles of the invention. It will thus be appreciated that those skilled in the art will be able to devise various arrangements which, although not explicitly described or shown herein, embody the principles of the invention and are included within its spirit and scope.

Furthermore, all examples and conditional language recited herein are principally intended expressly to be only for pedagogical purposes to aid the reader in understanding the principles of the invention and the concepts contributed by the inventor(s) to furthering the art, and are to be construed as being without limitation to such specifically recited examples and conditions.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the invention.

Figure 1:
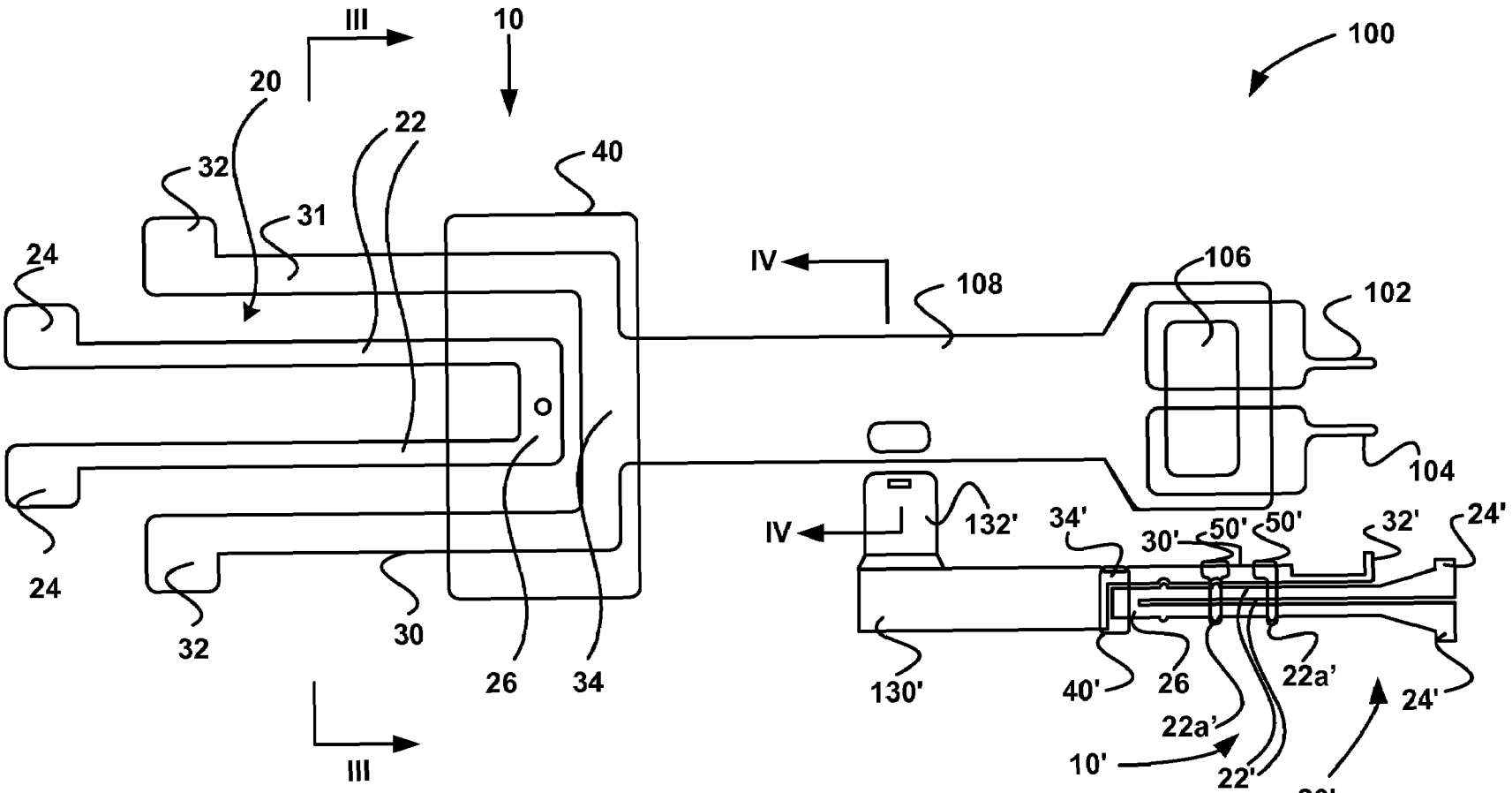
FIG. 1 is a schematic of an exemplary MEMS switch according to the present invention.

FIG. 1 shows an example of a MEMS switch (100) constructed according to the principles of the present invention. The switch (100) comprises two MEMS actuators (10, 10'). The MEMS switch (100) is used to selectively close or open a circuit between a pair of contact terminals (102, 104) using a movable conductive member (106) mounted at the end of a support arm (108).

When the MEMS switch (100) is in a closed position, the contact terminals (102, 104) are electrically engaged—that is to say an electrical current may flow between the two contact terminals (102,104). This electrical engagement is realized when the movable conductive member (106) electrically "shorts" the pair of contact terminals (102, 104).

Conversely, when the MEMS switch (100) is in an open position, the contact terminals (102, 104) are not electrically engaged and no appreciable electrical current flows between them. In preferred embodiments, the movable conductive member (106) is gold plated.

It should be noted that in FIG. 1 and certain subsequent figures the contact terminals (102, 104) are visible and the support arm (108) and the movable conductive member (106) appear transparent. This is not to show any transparency of the parts, only to enhance the visibility of those parts which would otherwise be eclipsed in the drawing.

We have discovered that that using contact terminals (102, 104) such as those shown and a movable conductive member (106) allows the conducting of higher currents than MEMS devices in which an electrical conducting path goes along a length of the MEMS actuators (10, 10') themselves. Advantageously, and as a direct result of our inventive MEMS structure (100), it is now possible to employ MEMS switches while—at the same time—avoid using current limiters. As a result, overall manufacturing costs of systems employing MEMS switches may be significantly reduced.

Figures 2, 2A, 2B:
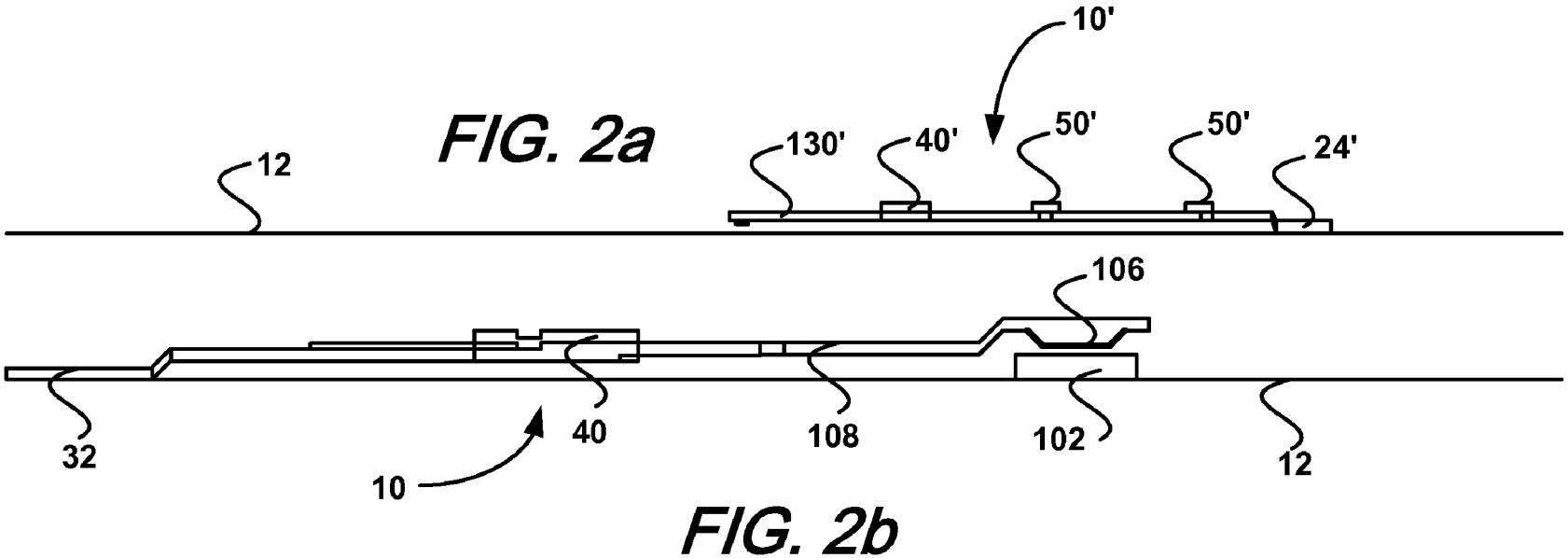
FIGS. 2*a* and 2*b* are side views of actuators employed by the MEMS switch of FIG. 1.

Turning our attention now to FIGS. 2*a* and 2*b*, there is shown side views of the actuators (10, 10') of FIG. 1 which are mounted on a substrate (12) in a cantilever fashion. One example of the substrate (12) is a silicon wafer—a very well characterized substrate. As can be readily appreciated by those skilled in the art however, our invention is not limited to silicon substrates.

Referring back to FIG. 1, each of the actuators (10, 10+) comprises an elongated hot arm member (20, 20') having two spaced-apart portions (22, 22'). Each spaced-apart portion (22, 22') is provided at one end with a corresponding anchor pad (24, 24') connected to the substrate (12).

In each actuator (10, 10'), the spaced-apart portions (22, 22') are substantially parallel and connected together at a common end (26, 26') that is shown opposite the anchor pads (24, 24') and overlying the substrate (12).

Each of the actuators (10, 10') also comprises an elongated cold arm member (30, 30') adjacent and substantially parallel to the corresponding hot arm member (20, 20'). Each cold arm member (30, 30') has, at one end, an anchor pad (32, 32') connected to the substrate (12) and a free end (34, 34') that is opposite the anchor pad thereof (32, 32'). The free ends (34, 34') overlie the substrate (12).

The cold arm member (30) of the first actuator (10) has two portions (31). The free end (34) of the second actuator (10') is the location from which extends an extension arm (130'). The extension arm (130') is itself provided with a side extension arm (132') at its free end. It should be noted that the hot arm member (20') and the cold arm member (30') of the second actuator (10') can be made longer than what is shown in the figure. It is thus possible to omit the extension arm (130') and connect the side extension arm (132') directly on the side of the free end (34') or even elsewhere on the second actuator (10').

A dielectric tether (40, 40') is attached over the common end (26, 26') of the portions (22, 22') of the hot arm member (20, 20') and over the free end (34, 34') of the cold arm member (30, 30'). The dielectric tether (40, 40') is provided to mechanically couple the hot arm member (20, 20') and the cold arm member (30, 30') and to keep them electrically independent, thereby maintaining them in a spaced-apart relationship with a minimum spacing between them to avoid a direct contact or a short circuit in normal operation as well as to maintain the required withstand voltage, which voltage is proportional to the spacing between the corresponding members (20, 30 and 20', 30').

It should be noted that the maximum voltage used can be increased by changing of the ambient atmosphere. For instance, the use of high electro-negative gases as ambient atmosphere would increase the withstand voltage. One example of this type of gases is Sulfur Hexafluoride, $SF_6$.

The dielectric tether (40, 40') is preferably molded directly in place at the desired location and is attached by direct adhesion. Direct molding further allows having a small quantity of material entering the space between the parts before solidifying. Advantageously, the dielectric tether (40, 40') may be attached to the hot arm member (20, 20') and the cold arm member (30, 30') in a different manner than the one shown in the figures. Moreover, the dielectric tethers (40, 40') can be transparent as illustrated in some of the figures.

Each dielectric tether (40, 40') is preferably made entirely of a photoresist material. A suitable material for that purpose, which is also easy to manufacture, is the material known in the trade as "SU-8". The SU-8 is a negative, epoxy-type, near-UV photo resist based on EPON SU-8 epoxy resin (from Shell Chemical). Of course, other photoresist may be used as well, depending upon the particular design requirements. Other possible suitable materials include polyimide, spin on glass, oxide, nitride, ORMOCORE™, ORMOCLAD™ or other polymers. Moreover, combining different materials is also possible and well within the scope of the present invention. As can be appreciated, providing each dielectric tether (40, 40') over the corresponding actuator (10, 10') is advantageous because it allows using the above-mentioned materials, which in return provides more flexibility on the tether material and a greater reliability.

Figure 3:
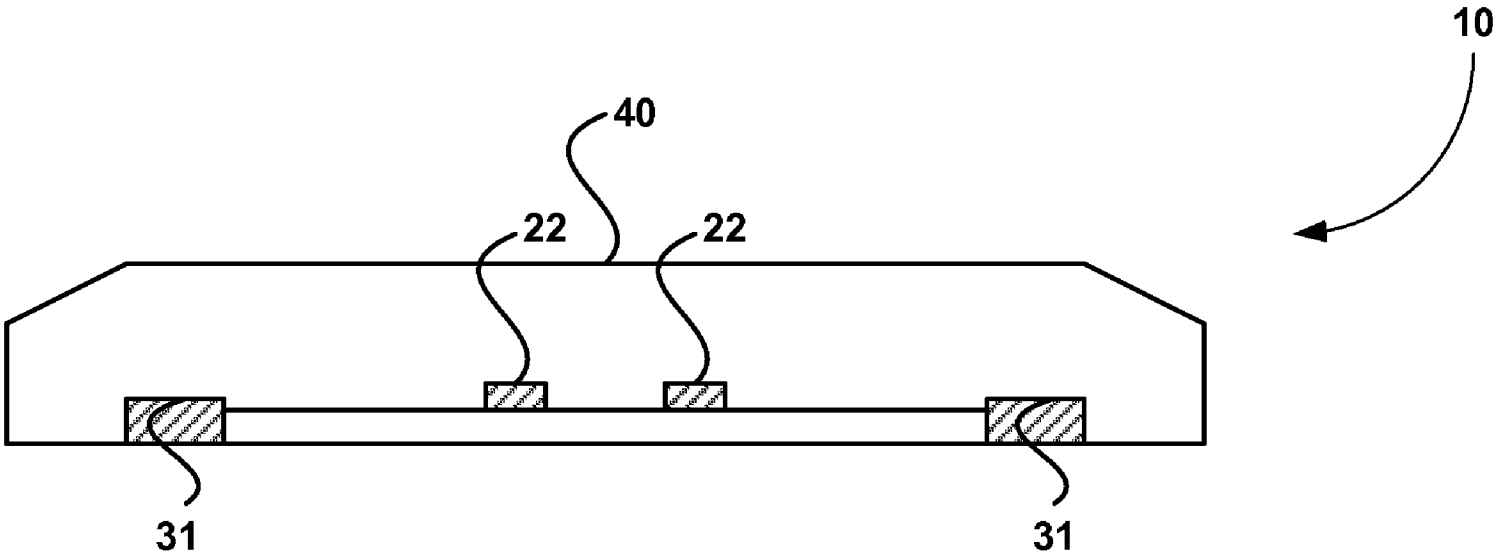
FIG. 3 is a cross-sectional view taken along line III-III in FIG. 1.

FIG. 3 is a cross-sectional view taken along line III-III in FIG. 1. It shows that the hot arm member portions (22) of the first actuator (10) are slightly above the plane of the cold arm member portions (31). The dielectric tether (40) is also visible in this figure.

Figure 4:
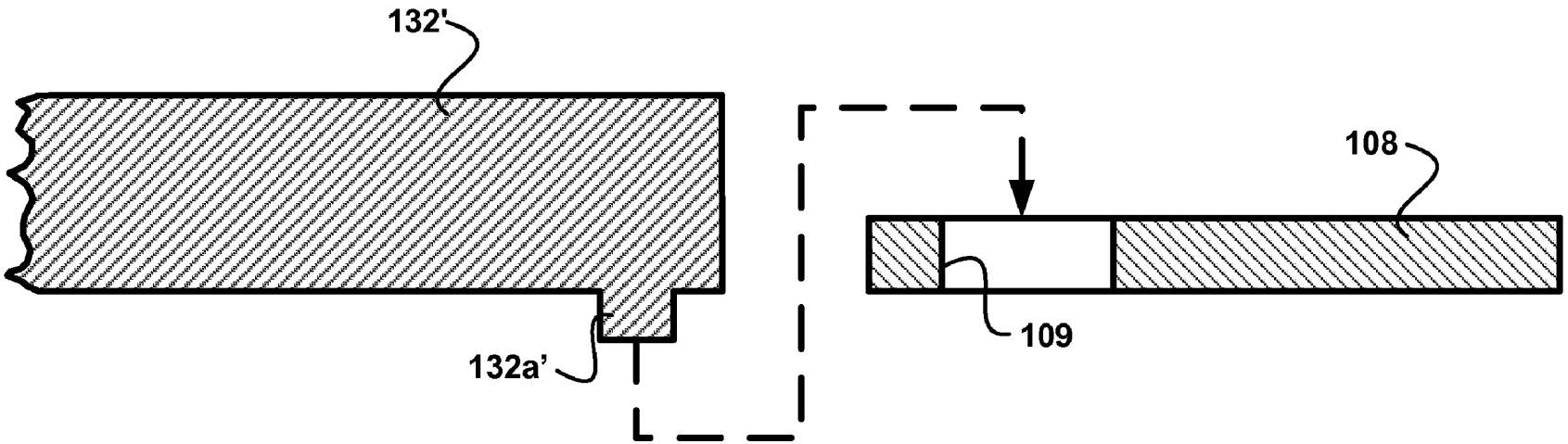
FIG. 4 is a cross-sectional view taken along line IV-IV in FIG. 4 showing a side extension arm and bottom peg and corresponding hole.

FIG. 4 is a cross-sectional view taken along line IV-IV in FIG. 4. It shows that the side extension arm (132') comprises a bottom peg (132*a*'), whereas the support arm (108) comprises a corresponding hole (109).

In use, when a control voltage is applied at the anchor pads (24, 24') of the hot arm member (20, 20'), a current travels into the first and second portions (22, 22'). In the various embodiments illustrated herein, the material(s) comprising the hot arm members (20, 20') is/are sufficiently conductive so that it increases in length as it is heated. The cold arm members (30, 30'), however, do not substantially exhibit such elongation since no current is initially passing through them.

In the embodiment depicted in FIG. 1, when a control voltage is applied at anchor pads (24) of the hot arm member (20) of the first actuator (10), the member becomes heated and the free end of the first actuator (10) is deflected downwards (towards the substrate) because of the heating induced elongation thereby moving the support arm (108) from a neutral position to a deflected position. Conversely, removing the control voltage results in the hot arm member (20) cooling and the support arm (108) returning to its original (neutral) position. Advantageously, both movements may occur very rapidly.

The second actuator (10') is designed and configured to deflect its free end (34') sideways when a potential is applied to its anchor pads (24'). In this manner, the first set of actuators and this second set of actuators move perpendicular to one another. More specifically, and as shown in this figure, the first actuator moves in a direction substantially perpendicular to the plane of the underlying substrate (towards/away-down/up) while his second actuator moves in a plane parallel to the surface plane of the substrate. Of course, the use of the "first" and "second" are only exemplary.

Continuing with the discussion of FIG. 1, it is noted that the second actuator (10') in the embodiment shown in FIG. 1 optionally includes a set of two spaced-apart additional dielectric tethers (50'). These additional dielectric tethers (50') are transversally disposed over the portions (22') of the hot arm member (20') and over the cold arm member (30') and adhere to these parts.

According to an aspect of the present invention, it is advantageous to provide at least one of these additional dielectric tethers (50') so as to provide additional strength to the hot arm member (20') bu redicomg tjeor effective length thereby preventing distortion of the hot arm member (20') over time. Since the gap between the parts is extremely small, the additional tethers (50') reduce the risks of a short circuit happening between the two portions (22') of the hot arm member (20') or between the portion (22') of the hot arm member (20') that is closest to the cold arm member (30') and the cold arm member (30') itself by keeping them in a spaced-apart configuration. Additionally, since the two portions (22') of the hot arm member (20') are relatively long, they tend to distort when heated to produce the deflection, thereby decreasing the effective stroke of the actuators (10'). The additional dielectric tethers (50') advantageously alleviate this problem.

As can be appreciated, using one, two or more additional dielectric tethers (50') has many advantages, including increasing the rigidity of the portions (22') of the hot arm member (20'), increasing the stroke of the actuators (10'), decreasing the risks of shorts between the portions (22') of the hot arm members (20') and increasing the breakdown voltage between the cold arm members (30') and hot arm members (20').

The additional dielectric tethers (50') are preferably made of a material identical or similar to that of the main dielectric tethers (40'). Small quantities of materials are advantageously allowed to flow between the parts before solidifying in order to improve the adhesion. In addition, one or more holes or passageways (not shown) can be provided in the cold arm members (30') to receive a small quantity of material before it solidifies to ensure a better adhesion.

As may be seen in FIG. 1, the additional tethers (50') are preferably provided at enlarge points (22') along the length of each actuator (10'). These enlarged points (**22*a*'**) offer a greater contact surface and also contribute to dissipate more heat when a current flows therein. Providing a larger surface and allowing more heat to be dissipated advantageously increases the actuator operating lifetime.

FIGS. **5*a* through 5*g* schematically show an example of the relative movement of the MEMS actuators (10, 10') when the MEMS switch (100) goes from an "open position" to a "closed position", thereby closing the circuit between the two contact terminals (102, 104). To move from one position to the other, the actuators (10, 10'**) are operated in sequence.

Figure 5:
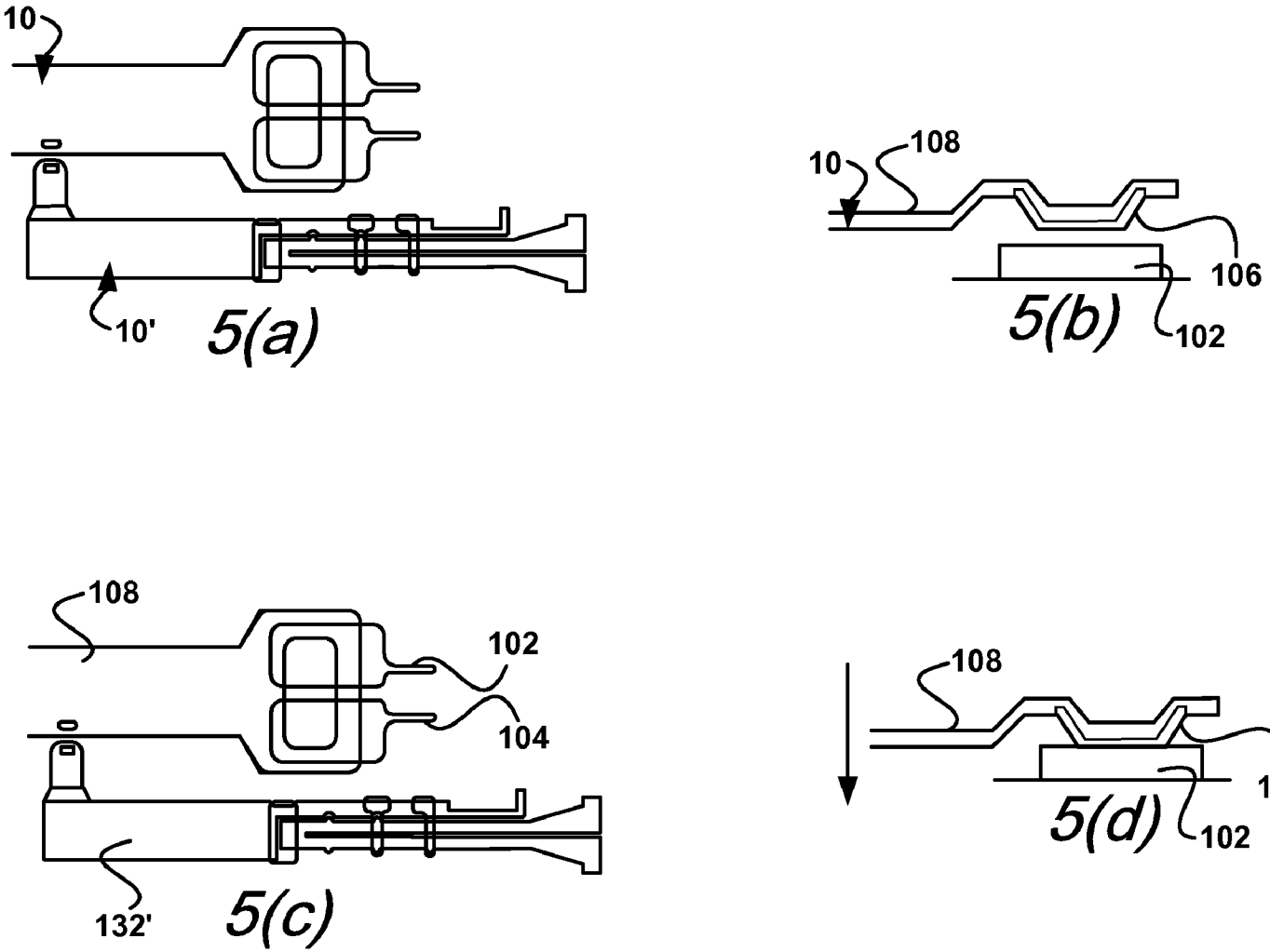
FIGS. 5*a* through 5*g* schematically show an example of the relative movement of the MEMS actuators when the MEMS switch goes from an "open position" to a "closed position"
Figure 5:
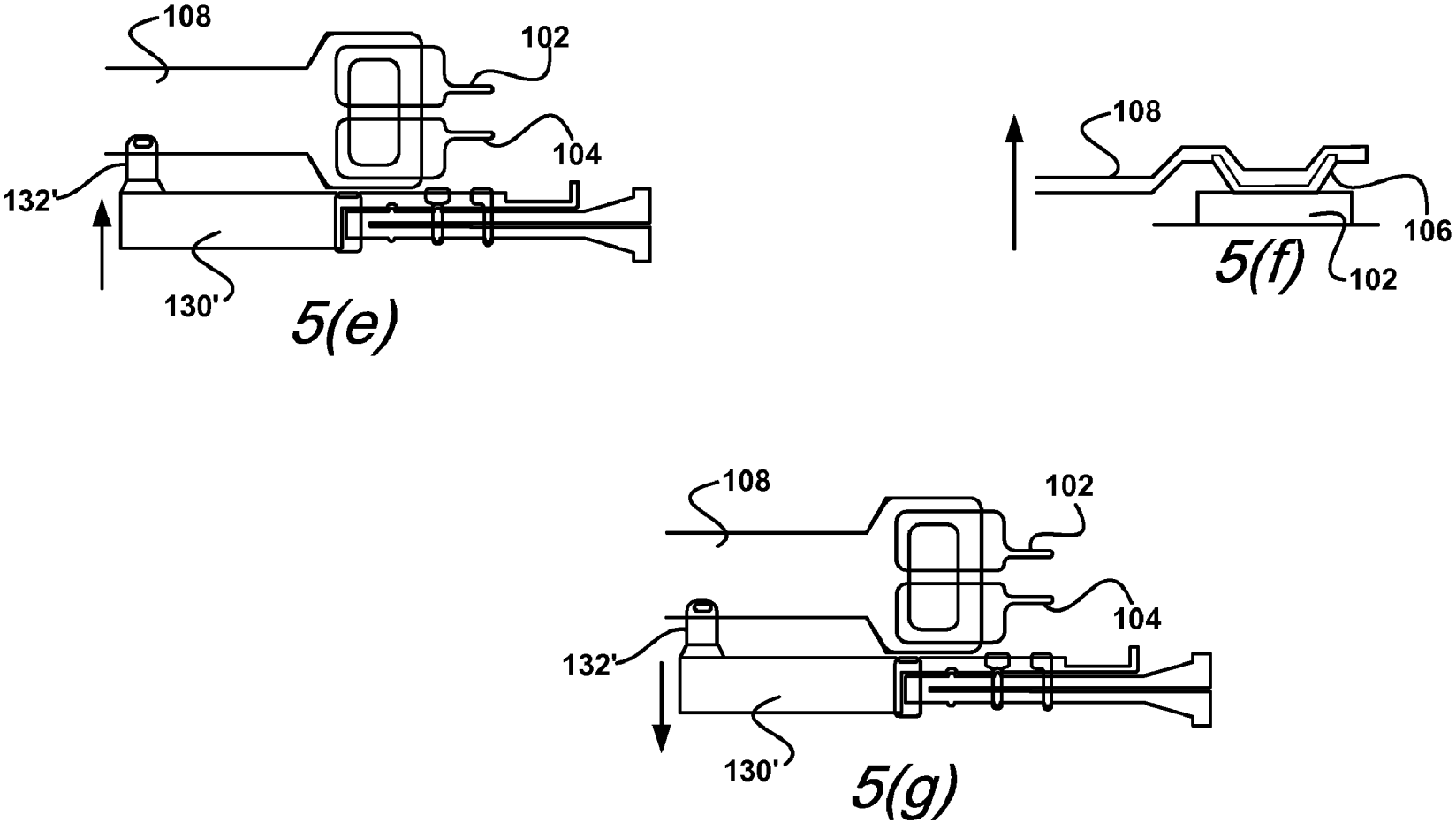
Figure 6:
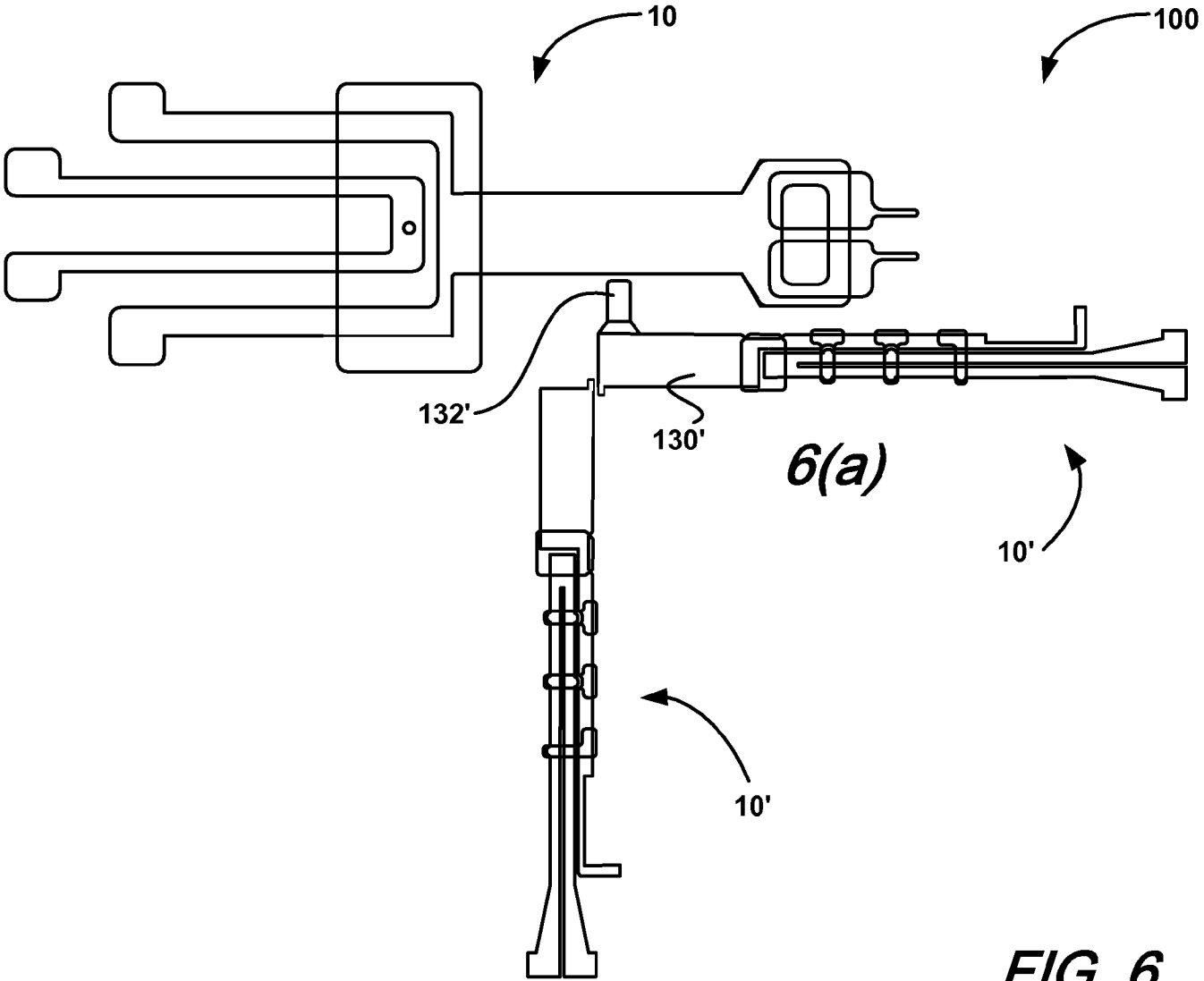
FIGS. 6*a* and 6*b* shows a schematic of yet another alternate embodiment of the exemplary MEMS switch of FIG. 1.
Figure 6:
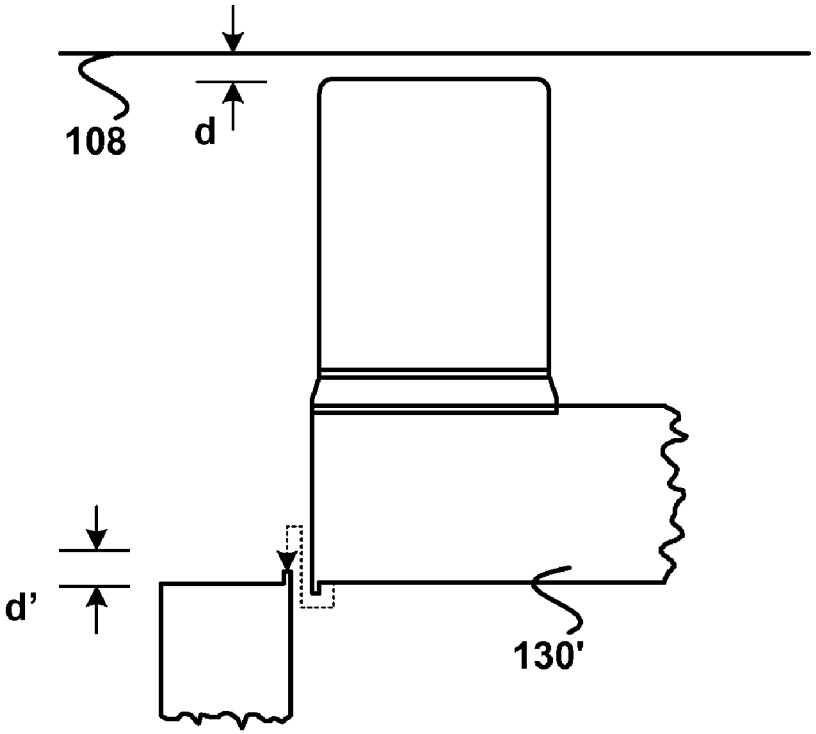

More particularly, FIG. **5*a* and 5*b* show the initial position of the MEMS switch (100). In FIGS. 5*c* and 5*d*, the hot arm member (20) of the first actuator (10') is activated so that the conductive member (106) is deflected downward toward the underlying substrate. Then, as shown in FIG. 5*e*, the side extension arm (132') of the second actuator (10') is deflected to its right (parallel to the surface of the underlying substrate) upon activation of its corresponding hot arm member (20'). At that point, a bottom peg (132*a*') is in appropriate alignment with hole (109) of support arm (108), which are shown in FIG. 4**.

FIG. **5*f* shows the effect of control voltage in the first actuator (10) being released, which causes support arm (108) to engage the bottom side of the side extension arm (132') of the second actuator (10') as it returns towards its neutral position. The peg (132*a*') is then retained in the hole (109) The, as shown in FIG. 5*g*, the control voltage of the second actuator (10') is subsequently released, thereby allowing a stable engagement between both actuators (10, 10'). The design of the first actuator (10) must allow the contact member (106) to be pressed against the contact terminals (102, 104) even when the base of the support arm (108**) moves slightly up when the control voltage is released.

As can be observed from these figures, as soon as the movable conductive member (106) is moved, it is urged against the contact terminals (102, 104) and the circuit is closed. The closing of the MEMS switch (100) is very rapid, all this occurring in typically a few milliseconds. As can be appreciated, the MEMS switch (100) may be opened by reversing the above-mentioned operations.

FIG. **6*a* illustrates an alternate embodiment. This embodiment is similar to the one illustrated in FIG. 1, with the exception that it comprises two second actuators (10') and no peg and hole arrangement. As shown, the first actuator (10) is maintained in the closed position only by the presence of the side extension arm (132') of the pair of second actuators (10'). Operation of these two second actuators (10') is described in U.S. patent application Ser. Nos. 10/782,708 and 60/464,423, which, as noted earlier, are hereby incorporated by reference. As can be appreciated by those skilled in the art, the two second actuators (10') move substantially parallel to the planar surface of a substrate upon which they are disposed. In addition they move in a direction that is substantially perpendicular to one another. In this manner, once the first actuator (10**) is moved into its actuated position, it is held in that position through the effect of one of the two second actuators, the second one of which secures the first.

FIG. **6*b* shows that when the actuators of a same pair will be set to their "closed" position, the side extension arm (132') of the actuator closer to the first actuator will be displaced of the distance "d'". This distance (d') is greater than the distance (d) between the tip of the side extension arm (132') and the edge of the support arm (108**) of the first actuator.

Figure 7:
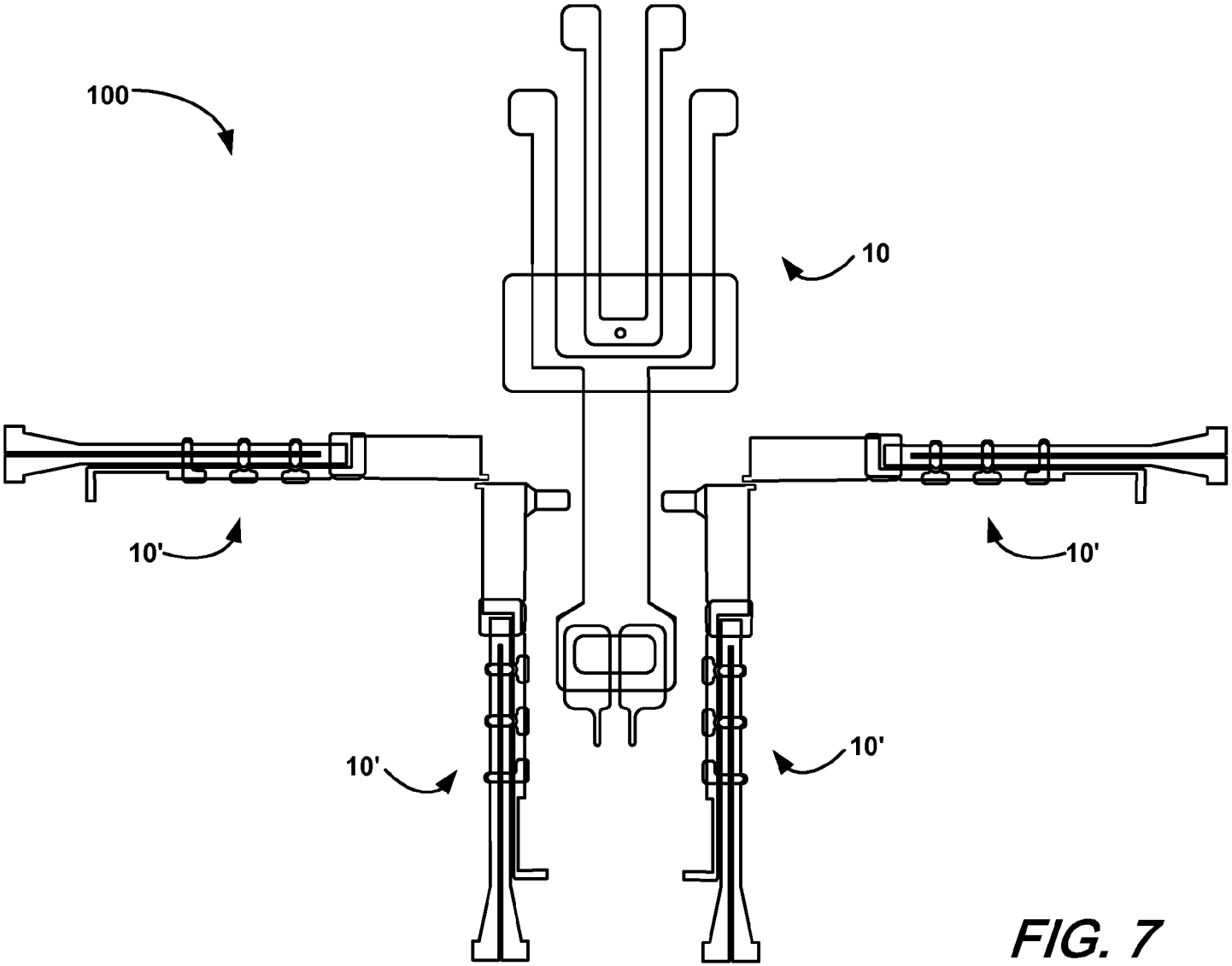
FIG. 7 shows a schematic of yet another alternate embodiment of the exemplary MEMS switch of FIG. 1.

FIG. 7 illustrates another alternate embodiment. This variant of FIG. **6*a* comprises the two pairs of second actuators (10'). One of the second actuators (10') is parallel to the first actuator (10) while the other second actuator (10') is perpendicular with reference to the first actuator (10). One goal of the symmetrical positioning of the second actuators (10') is to have the same electrical contact on each contact terminal (102, 104**).

Figure 8:
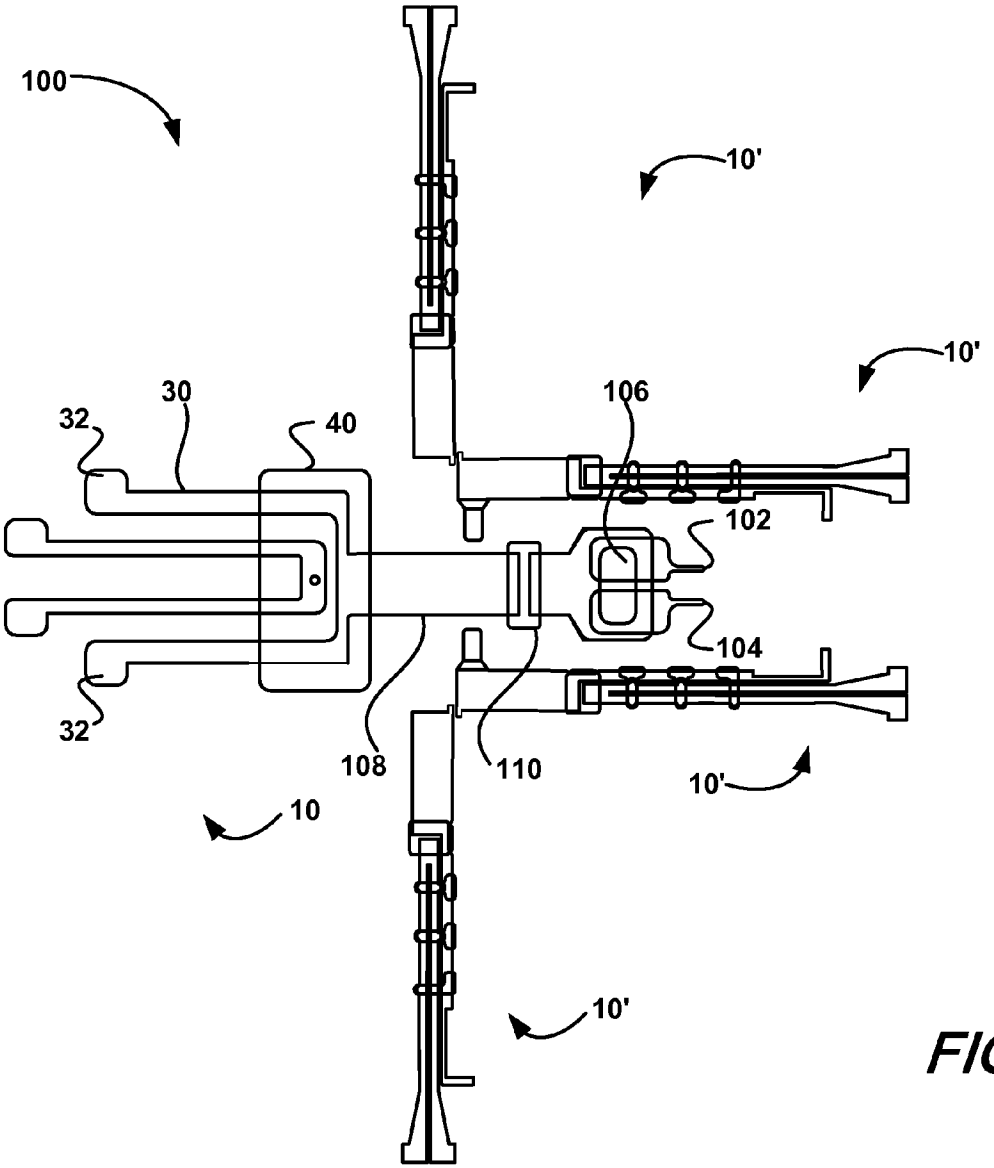
FIG. 8 is a schematic of yet another alternate embodiment of the MEMS switch of FIG. 1.

FIG. 8 illustrates yet another alternative embodiment. In this embodiment, the support arm (108) is electrically insulated with a dielectric tether (110). This allows, for instance, providing a potential between the anchor pads (32) of the "cold" arm member (30) of the actuator (10). In this manner, stiction effects between the contact terminals (102, 104) and the movable conductive member (106) in the first actuator (10) can be broken.

As may be understood by those skilled in the art, stiction can be generally defined as a retention force urging the conductive member (106) to stay on the contact terminals (102, 104). Microwelding is one possible cause of stiction, especially if the conductive member (106) stays in contact with the contact terminals (102, 104) for a long period of time. The "cold" arm member (30) then becomes a "hot" arm member when a potential is applied and this generates a positive force pushing up the conductive member (106) to break the contact. The pushing force is added to the natural spring force of the actuator (10). This feature can be used with any of the other possible designs, provided that electric insulation is provided at an appropriate location to insulate the parts. The main tether (40) of the first actuator (10) can also be used to insulate the support arm (108) from the base of the first actuator (10).

Figure 9:
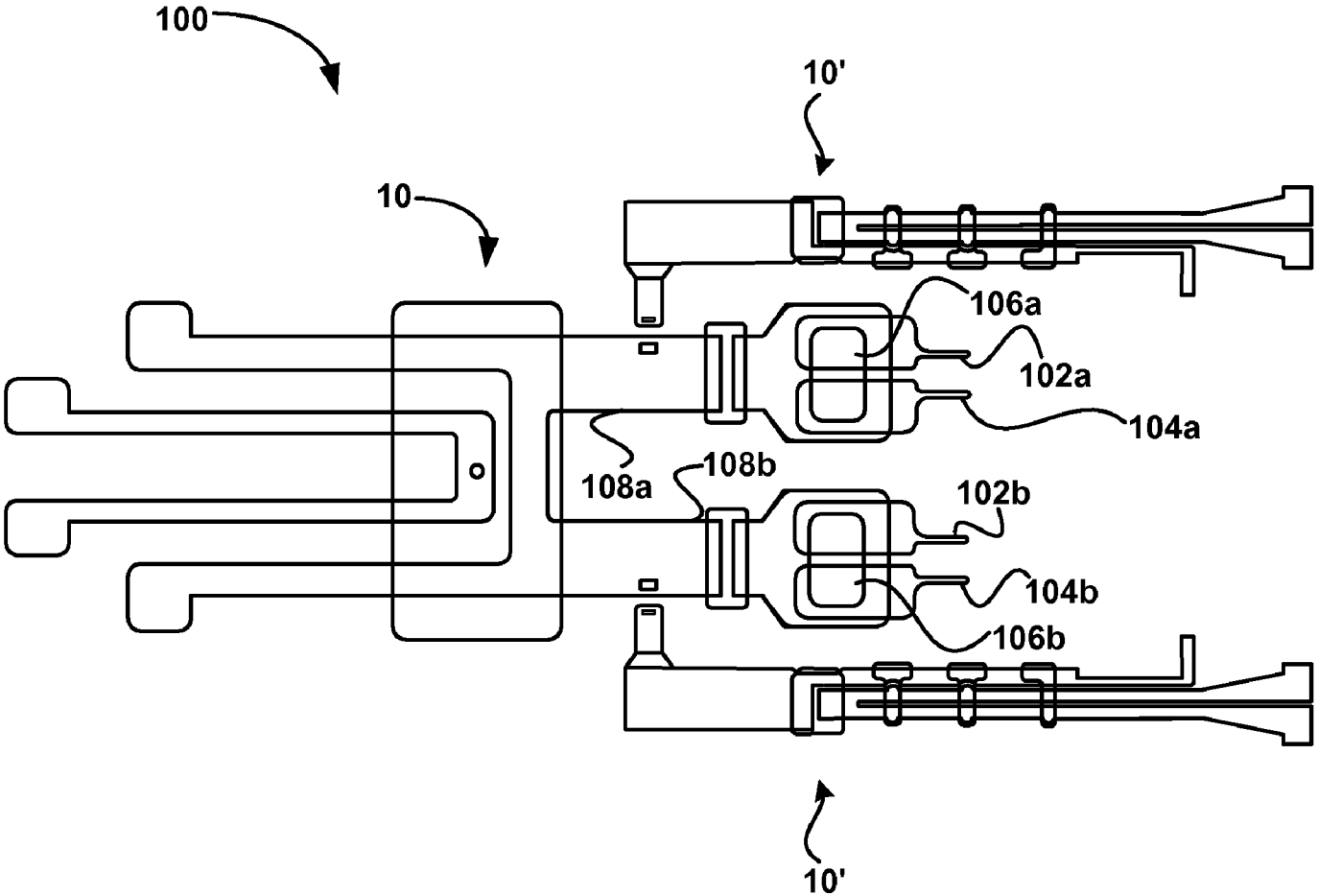
FIG. 9 is a schematic of another alternate embodiment of the MEMS switch of FIG. 1 employing multiple contact pads and multiple pairs of contact terminals.

FIG. 9 illustrates still another embodiment. In this embodiment, the first actuator (10) has two support arms (108*a*, 108*b*) to support two movable conductive members (106*a*, 106*b*). One movable conductive member (106*a*) can short the corresponding pair of contact terminals (102*a*, 104*a*). The other movable conductive member (106*b*) can short the corresponding pair of contact terminals (102*b*, 104*b*). Two second actuators (10') are used to maintain the circuits in a closed position. These second actuators (10') can be used with any other kind of first actuator (10), for instance the one illustrated in FIG. 1.

It is understood that the above-described embodiments are illustrative of only a few of the possible specific embodiments which can represent applications of the invention. Numerous and various other arrangements and materials may be made by those skilled in the art without departing from the spirit and scope of the invention.

The invention claimed is:

1. A microelectromechanical (MEMS) switch comprising:

a substrate having a planar top surface;

a first movable actuator affixed to the top surface of the substrate in a cantilever manner such that it has a substantially immovable end and a free movable end; and a second movable actuator affixed to the top surface of the substrate in a cantilever manner such that it has a substantially immovable end and a free movable end;

a pair of electrical contacts disposed upon the substrate;

an electrical conductive member attached to the movable end of the first actuator such that the conductive member electrically contacts the pair of electrical contacts when the first actuator is in its deflected position;

a latching mechanism which secures the first movable actuator and the second movable actuator in their deflected positions wherein upon activation said first movable actuator moves from a neutral position to a deflected position wherein said first actuator movement is in a direction perpendicular to the planar substrate surface and said second movable actuator upon activation moves from a neutral position to a deflected position wherein said second actuator movement is in a direction parallel to the planar substrate surface;

wherein the first movable actuator includes a hot arm member and a cold arm member said hot arm member having a pair of pads affixed to the substrate such that when a sufficient electrical current flows between the pair of pads the hot arm member elongates sufficiently to effect the movement of the first movable actuator to its deflected position; and wherein the cold arm member of the first movable actuator comprises a pair of pads affixed to the substrate such that when a sufficient electrical current flows between the pair of pads the cold arm member elongates sufficiently to effect the movement of the first movable actuator towards its neutral position.

2. The MEMS switch of claim 1 wherein the second movable actuator comprises a hot arm member and a cold arm member said hot arm member having a pair of pads affixed to the substrate such that when a sufficient electrical current flows between the pair of pads the hot arm member elongates sufficiently to effect the movement of the second movable actuator to its deflected position.

3. The MEMS switch of claim 2 wherein a portion of the latching mechanism is provided on the first movable actuator and a mated other portion of the latching mechanism is provided on the second movable actuator such that the latching mechanism becomes engaged upon movement of the actuators to their deflected position.

4. The MEMS switch of claim 1 wherein said mated portions of the latching mechanism includes a pin and a hole.

5. A MEMS switch comprising:

a substrate having a planar surface upon which is disposed at least a pair of electrical contacts;

means for electrically connecting the pair of electrical contacts wherein said means for electrically connecting the pair of electrical contacts moves from a neutral position to a deflected position in a direction that is substantially perpendicular to the planar surface to effect the electrical connecting; and means for securing the means for electrically connecting the pair of electrical contacts in its deflected position wherein said means for securing the means for electrically connecting the pair of electrical contact moves from a neutral position to a deflected position in a direction that is substantially parallel to the planar surface to effect the securing;

means for maintaining the means for securing the means for electrically connecting the pair of electrical contacts in its deflected position thereby securing the means for electrically connecting the pair of electrical contacts in its deflected position;

means for moving the means for electrically connecting the pair of electrical contacts from its normal position to its deflected position upon application of a sufficient control voltage thereby elongating a portion of the means for electrically connecting the pair of electrical contacts;

means for moving the means for electrically connecting the pair of electrical contacts from its deflected position to its normal position upon application of a sufficient control voltage thereby elongating a portion of the means for electrically connecting the pair of electrical contacts wherein said means for moving the means for electrically connecting the pair of electrical contacts from its deflected position to its normal position is not the same as the means for moving the means for electrically connecting the pair of electrical contacts from its normal position to its deflected position.

* * * * *